US005374810A

United States Patent [19]

Gantt

[11] Patent Number: 5,374,810

[45] Date of Patent: Dec. 20, 1994

[54] INDUCTION HEATING TRANSFORMER AND METHOD OF WINDING SAME

[76] Inventor: Jackie L. Gantt, 3348 Old Kentucky Rd., Morristown, Tenn. 37814

[21] Appl. No.: 894,560

[22] Filed: Jun. 5, 1992

[51] Int. Cl.[5] ..... H05B 6/04

[52] U.S. Cl. ..... 219/670; 219/672; 336/182

[58] Field of Search ..... 219/10.492, 10.491, 219/10.61 R, 10.61 A, 660, 670, 671, 672, 676; 335/216; 336/182, 205; 29/605; 428/610, 383; 73/861.38

[56] References Cited

U.S. PATENT DOCUMENTS

| | | | |
|---|---|---|---|
| 3,412,228 | 11/1968 | Miyagi | 219/10.61 |
| 3,412,229 | 11/1968 | Seagrave, Jr. | 219/10.61 |
| 3,633,140 | 1/1972 | Lake | 336/182 |
| 3,662,461 | 5/1972 | Lake et al. | 29/605 |
| 3,875,673 | 4/1975 | Good | 335/216 |
| 4,342,814 | 8/1982 | Usuki et al. | 428/383 |
| 4,788,394 | 11/1988 | Vanneste et al. | 219/10.61 |
| 4,876,898 | 10/1989 | Cage et al. | 73/861.38 |
| 4,948,466 | 8/1980 | Jaakkola | 162/207 |
| 5,140,292 | 8/1992 | Aronow | 336/205 |
| 5,209,987 | 5/1993 | Penneck et al. | 428/610 |

*Primary Examiner*—Bruce A. Reynolds

*Assistant Examiner*—Tu Hoang

*Attorney, Agent, or Firm*—Pitts & Brittian

[57] ABSTRACT

An improved transformer (10) for heating a selected filament during a stretching procedure to enhance the quality and tensile strength of the filament. The transformer (10) is fabricated around a spool body (12) which is mounted on a motor and received within a rotating shield. As power is supplied to the transformer (10), heat is generated, a portion of this heat being transferred to the rotating shield and finally to the selected filament. A base layer of insulation (14) is applied to an exterior surface of the spool body (12), including the flanges (32,38), for preventing generated heat from damaging the spool (12) and also to prevent an inductor wire (18) from shorting on the spool (12). The inductor wire (18) is wrapped from one end of the spool body (12) to the other. During the wrapping of the inductor wire (18), an insulating material (20) is sprayed on to fill any voids between the wire (18) and the spool (12), and between the individual turns of the inductor wire (18). A selected number of layers of inductor wire (18) is wound on the spool (12). Between each layer of inductor wire (18) is applied a selected insulation material (22). A layer of insulating fabric (24) is applied after the final layer of inductor wire (18). A final coat of insulating material (20) is then applied.

19 Claims, 2 Drawing Sheets

INDUCTION HEATING TRANSFORMER AND METHOD OF WINDING SAME

TECHNICAL FIELD

This invention relates to the textile industry. More specifically, this invention relates to a transformer for heating a rotating shell used in the processing of filaments used in making carpets and tires.

BACKGROUND ART

In the field of manufacturing carpet, it is well known that the yarns used are heated and stretched to attain as high a tensile strength as possible, thereby yielding a stronger filament. In so heating and stretching the yarns, the yarn is taken from a supply spool, wrapped around a pre-heating spool, and then wrapped around a final heating spool. It is well known that currently, the final heating spool is capable of achieving surface temperatures in the range of 200° C. to 230° C. The heating elements used to heat the final heating spools are capable of attaining temperatures in the range of 300° C. to 500° C.

It is well known that the heating capacity of the yarns is somewhat higher than that currently attainable by existing heaters. Therefore, it is desirable to provide a heater which may be used to heat the surface of the final heating spool to at least the maximum temperature allowable for the selected material being heated.

Devices currently used include transformers composed of insulated copper wires wrapped a selected number of times to induct heat into the associated spool. The physical characteristics of these transformers limit their heating capacities. The insulation used on these transformers has a temperature limit at which cracks form. With cracks and other defects in the insulation, the copper wire is allowed to oxidize, thereby creating breaks in the wire, which yield the transformer useless. The deficiencies of the insulation are costly, as they may require much shut-down time for the associated machinery, and may be otherwise expensive to correct.

The wire used in typical devices has also posed a problem. Copper wire is known to be an excellent conductor of heat. However, when exposed to air, it is also well-known to be prone to oxidation. Again, the protection of the copper wire from such adversities is a function of the insulation, and the insulation typically used is inadequate.

Other devices have been produced to overcome these problems, such as those described in U.S. Pat. No. 3,412,228 issued to H. Miyagi on Nov. 19, 1968, and U.S. Pat. No. 3,412,229 issued to E. M. Seagrave, Jr., on Nov. 19, 1968. Still, these devices are not capable of reaching the desired level of output temperatures.

Other similar heaters are known in the art such as those described in U.S. Pat. No. 4,788,394 issued to G. Vanneste, et al., on Nov. 29, 1988, and U.S. Pat. No. 4,948,466 issued to J. Jaakkola on Aug. 14, 1990. Though each of these discloses an induction heater incorporating ceramic materials, neither is sufficient for the purposes of the present invention. The '394 patent discloses a multiwire induction heater designed to heat steel wires of a diameter between 0.5 and 3 mm to temperatures not exceeding 750°–760° C. The '466 patent discloses a heater for use in the paper manufacturing field and is designed to attain temperatures in the range of 140°–500° C. In the field of the present invention, it is desirable to attain temperatures up to 1000° C.

Polyester cords used in the manufacture of tires are processed similarly to the yarns used in the manufacture of carpets. The equipment used for processing these cords are limited in like fashion to those described above. Other filaments may also require similar processing.

Therefore, it is an object of this invention to provide a means for heating a selected filament to its maximum associated temperature in order to insure a maximum tensile strength from the selected filament.

Another object of the present invention is to provide such a means for heating a selected filament wherein a transformer is used as a heating source.

Still another object of the present invention is to provide such a transformer wherein copper wire may be used, the copper wire being protected from oxidation.

Yet another object of the present invention is to provide a means whereby the individual turns of the copper wire are insulated one from the other, the insulation being capable of withstanding the desired output temperatures of the transformer.

DISCLOSURE OF THE INVENTION

Other objects and advantages will be accomplished by the present invention which serves to heat a selected filament to a maximum temperature during a stretching procedure to enhance the tensile strength of the filament. Higher temperatures achievable by the present invention also serve to increase the productivity of the associated machinery. Filaments most often treated in this manner are those used in the manufacture of carpets and tires. Other filaments may be processed in like manner. The transformer is fabricated around a spool body which is mounted on a motor and received within a rotating shield. As power is supplied to the transformer, heat is generated, a portion of this heat being transferred to the rotating shield and finally to a selected filament. The spool body may be any existing spool body included with standard equipment readily available in the field.

A base layer of insulation is applied to an exterior surface of the spool body, including the flanges. The base insulation is provided to prevent generated heat from damaging the spool and also to prevent the inductor wire from shorting on the spool. The base insulation includes at least a layer of a selected ceramic material. The ceramic material of the preferred embodiment is capable of withstanding temperatures of up to 1000° C. A second layer, comprised of sheet mica sandwiched between two layers of woven glass fiber is wrapped around the base layer of ceramic material and then tightly held in place.

An inductor wire is wrapped from one end of the spool body to the other. During the wrapping of the inductor wire, an insulating material is applied to fill any voids between the wire and the spool, and between the individual turns of the inductor wire. The inductor wire is wound by securing the spool body at one end to a rotating means, attaching one end of the inductor wire to power supply lead wires at the first end of the spool, and rotating the spool via the rotating means. Hence, as the rotating means is operated, the wire will be wound around the spool. As the wire is wound around the spool, ceramic material is sprayed onto the spool to coat the wire previously wound and the area under which the next turn of wire will be wound. Thus, as the wire is wound around the spool, ceramic material is simultaneously applied to insure that no voids will exist between successive turns of the inductor wire and the base insulation, and further, that the inductor wire will be substantially encapsulated.

After the inductor wire has been wound from one end of the cylindrical member to the other, a selected insulation material is applied. The insulation material serves to separate individual layers of inductor wire. After the placement of the selected insulation material, another layer of inductor wire and ceramic material may be applied. The procedure of winding wire and simultaneously spraying ceramic material may be repeated a selected number of times. An insulating layer such as the described glass/mica/glass fabric is placed before each layer of inductor wire and ceramic material.

After the final layer of inductor wire and ceramic material has been placed, a layer of a woven glass fabric is applied. In the preferred embodiment, the selected material is a woven glass fiber. A final insulating coat of ceramic material is then sprayed over the woven glass fiber.

The entire process of winding the inductor wire and applying the selected insulating materials as described is performed while the ceramic material is wet, or slip. In order to properly cure the ceramic material, the improved transformer is air dried for a selected period of time and then fired for a selected period of time at selected temperatures, the times and temperatures varying for each selected ceramic material used.

After the curing process has been completed, the improved transformer may be secured to a selected motor in conventional fashion. Lead wires are provided for connecting the inductor wire to a power source for supplying electrical power to the transformer.

BRIEF DESCRIPTION OF THE DRAWINGS

The above mentioned features of the invention will become more clearly understood from the following detailed description of the invention read together with the drawings in which.

BEST MODE FOR CARRYING OUT THE INVENTION

Figure 1:
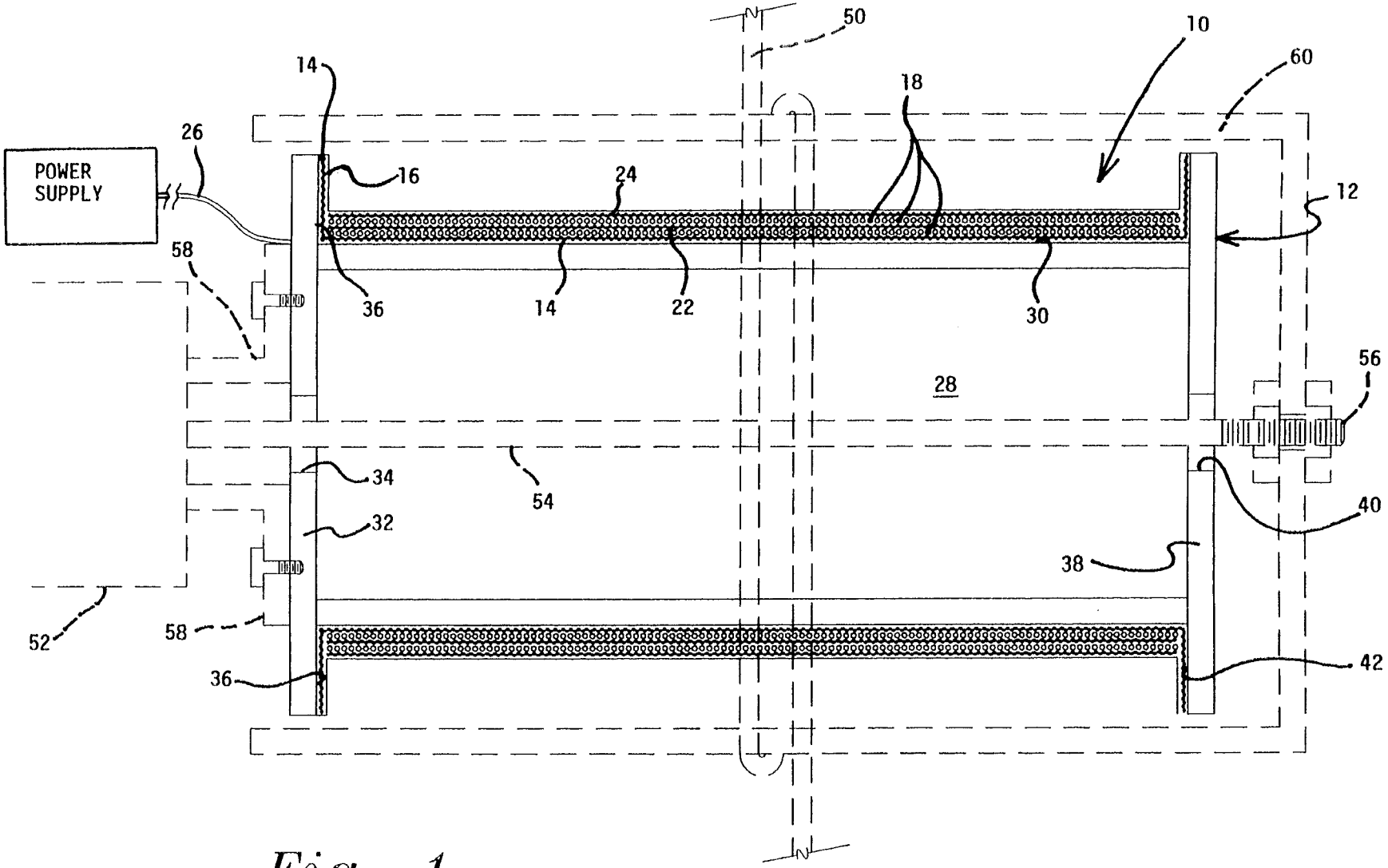
FIG. 1 is a side elevation view, partially in section, of the improved transformer constructed in accordance with several features of the present invention.
Figure 2:
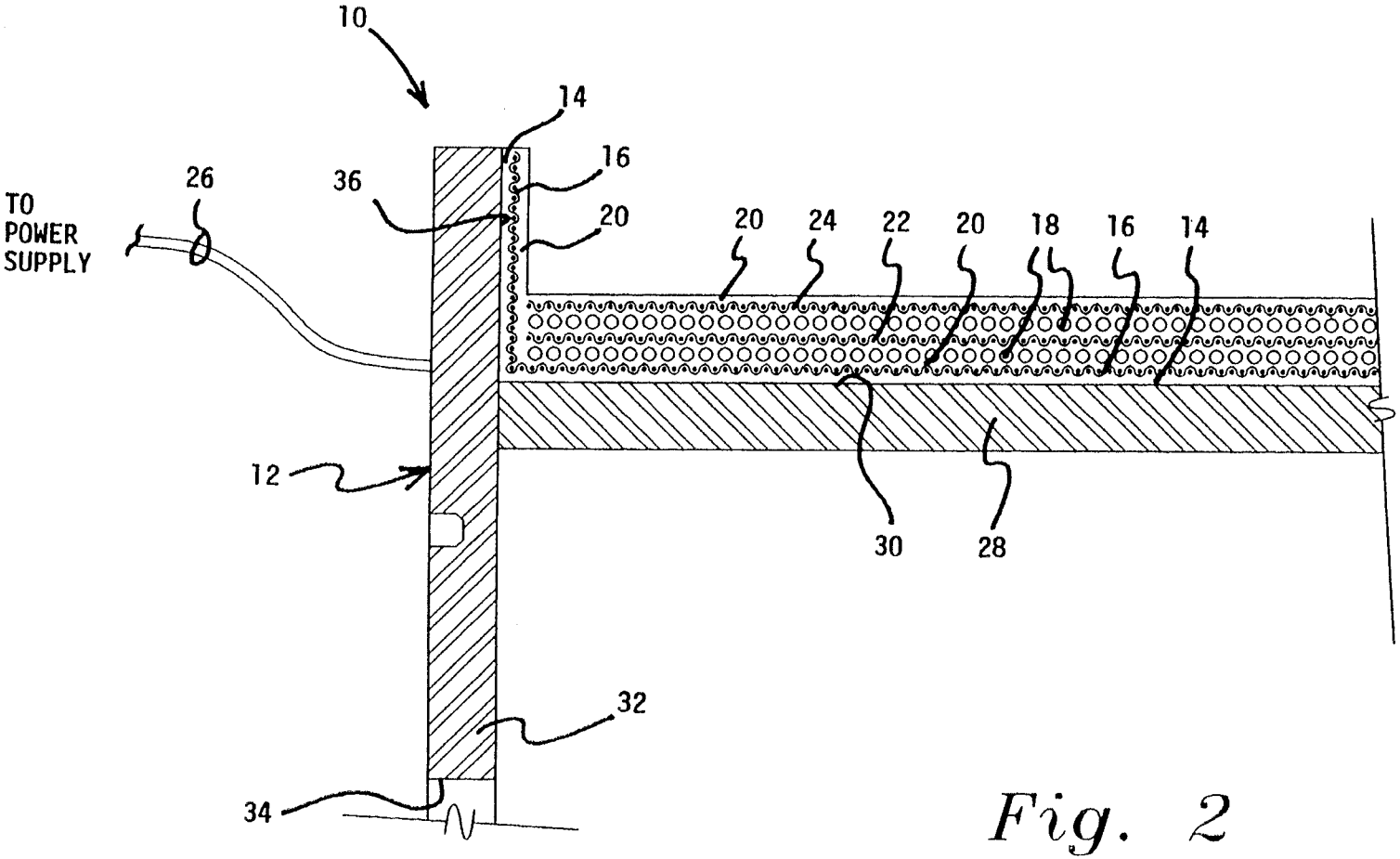
FIG. 2 illustrates an enlarged partial side elevation view, in section, of the improved transformer shown in FIG. 1.

An improved transformer incorporating various features of the present invention is illustrated generally at 10 in the figures. The improved transformer 10 is designed for heating a selected filament 50 to a maximum temperature to enhance the quality and tensile strength of the filament 50. Typically, the filaments 50 so processed are stretched when heated so that when cooled, the tensile strength is greatly increased. Filaments 50 most often treated in this manner are those used in the manufacture of carpets and tires. Other selected filaments may be processed in like manner. Higher temperature outputs also serve to increase the productivity of the associated machinery.

The improved transformer 10 is fabricated around a spool body 12 which is mounted on a motor 52 and received within a rotating shield 60. As power is supplied to the improved transformer 10, heat is generated. Subsequently, a portion of this heat is transferred to the rotating shield 60 and finally to a selected filament 50. The selected filament 50 is wrapped at least one time around the rotating shield 60 and is pulled at a rate substantially equal to the rotational velocity of the outer surface of the rotating shield 60. Heat is imparted in the filament 50 from direct contact with the rotating shield 60 during at least one revolution thereof, depending on the number of turns the filament 50 is wound about the rotating shield 60.

The spool body 12 includes a cylindrical member 28, a first end plate 32, or first flange, and a second end plate 38, or second flange. The first and second end plates 32,38 are oppositely disposed at either end of the cylindrical member 28. The spool body 12 may be any existing spool body 12 included with standard equipment readily available in the field. The spool body 12 is carried by the motor 52 by mounting the first end plate 32 to an adaptor plate 58, the adaptor plate 58 being fixed to the motor 52. Openings 34,40 are defined by the first and second end plates 32,38, respectively, for the passage of the motor shaft 54. The motor shaft 54 is connected at a distal end 56 to the rotating shield 60. Rotational movement of the motor shaft 54 is thus imparted to the rotating shield member 60.

A surface is defined by the exterior face 30 of the cylindrical member 28 and the proximate faces 36,42 of the annular surfaces of the first and second end plates 32,38 adjoining the exterior face 30 of the cylindrical member 28. This surface is coated with a base layer of insulation 14 to prevent generated heat from damaging the spool 12 and also to prevent the inductor wire 18 from shorting on the spool 12. The base insulation 14 of the preferred embodiment includes at least a layer of a selected ceramic material. The ceramic material may be applied by spraying. The ceramic layer defines a thickness of approximately 10/1000" (ten one-thousandths of an inch). The ceramic material of the preferred embodiment is capable of withstanding temperatures of up to 1000° C.

A second insulating layer 16 is then applied for insulating purposes. This second insulating layer 16 includes a fabric consisting of sheet mica sandwiched between two layers of woven glass fiber. The glass/mica/glass fabric (g/m/g fabric) of the preferred embodiment defines a thickness of approximately 20/1000" (twenty one-thousandths of an inch). The g/m/g fabric is wrapped around the base layer 14 of ceramic material and then tightly taped to retain the desired position. The overall thickness of the base layer 14 of ceramic material and the g/m/g fabric 16 may be selectively varied depending on the particular application. Increasing the thickness will yield greater insulating properties, and vice versa.

After the application of the layer of g/m/g fabric 16, an inductor wire 18 is wrapped from one end of the cylindrical member 12 to the other. During the wrapping of the inductor wire 18, an insulating material 20 is applied to fill any voids between the wire 18 and the spool 12, and between the individual turns of the inductor wire 18. As understood in the art, a turn is defined by one revolution of the wire 18 around the spool 12. In the preferred embodiment, the inductor wire 18 is fabricated from copper and plated with a selected material for preventing oxidation. Preferably, the copper wire is nickel-plated. The preferred insulating material is ceramic, as applied in the base insulation 14.

The preferred method of winding the inductor wire 18 includes securing the spool 12 at one end to a rotating means (not shown), attaching one end of the inductor wire 18 to one end of the spool 12, and rotating the spool 12 via the rotating means. Hence, as the rotating means is operated, the wire 18 will be wound around the spool 12. As the wire 18 is wound around the spool 12, ceramic material 20 is sprayed onto the spool 12 to coat the wire 18 previously wound and the area under which the next turn of wire 18 will be wound. Thus, as the wire 18 is wound around the spool 12, ceramic material 20 is simultaneously applied to insure that no voids will exist between successive turns of the inductor wire 18 and the second insulating layer 16, and further, that the inductor wire 18 will be substantially encapsulated by the ceramic material 20. Thus, the wire 18 will not contact any material other than the ceramic material 20, including contacting another turn of wire 18.

After the inductor wire 18 has been wound from one end of the cylindrical member 28 to the other, a selected insulation material 22 is applied. In the preferred embodiment, the insulation material 22 is the same material used in the second insulting layer 16 (glass/mica/glass fabric), as described above. The insulation material 22 serves to separate individual layers of inductor wire 18. After the placement of the selected insulation material 22, another layer of inductor wire 18 and ceramic material 20 may be applied.

The procedure of winding wire 18 and simultaneously spraying ceramic material 20 may be repeated a selected number of times. Typically, this procedure is repeated from 2 to 10 times. An insulating layer 22 such as the described g/m/g fabric is placed before each layer of inductor wire 18 and ceramic material 20. The number of layers of inductor wire 18 and ceramic material 20 does not substantially effect the output temperature. However, a greater number of turns of the inductor wire 18 will lower the power rating of the particular transformer 10.

After the final layer of inductor wire 18 and wire insulation material 20 has been placed, a layer of a selected insulating material 24 is applied. In the preferred embodiment, the selected material 24 is a woven glass fiber. This woven glass fiber is similar to that used in the glass/mica/glass fabric. A final insulating coat of ceramic material 20 is then sprayed over the woven glass fiber 24.

The entire process of winding the inductor wire 18 and applying the selected insulating materials 14,16,20,22,24 as described is performed while the ceramic material is in a wet state, otherwise known as slip. In order to properly cure the ceramic material 14,20, the improved transformer 10 is air dried for a selected period of time and then fired for a selected period of time at selected temperatures, the times and temperatures defining a curing profile. The curing profile may vary for each selected ceramic material used such that no bubbles or pin holes may form within the ceramic material. One ceramic material used has been found to cure most effectively by allowing the material to air dry for twenty-four (24) hours. After air-drying, the ceramic material is kiln dried at 100° F. for one (1) hour. The kiln temperature is increased to 200° F. for two (2) hours, to 400° F. for one (1) hour, and finally, 750° F. for one (1) hour.

After the curing process has been completed, the improved transformer 10 may be secured to a selected motor 52 in conventional fashion. The motor shaft 54 is received through the cylindrical member 28 and extends beyond the second end plate 38. The rotating shield 60 is then placed over the improved transformer 10 and secured to the motor shaft 54.

Lead wires 26 are provided for connecting the inductor wire 18 to a power source for supplying electrical power to the transformer 10. The lead wires 26 of the preferred embodiment are fabricated from teflon to endure the temperatures achieved by the improved transformer 10.

From the foregoing description, it will be recognized by those skilled in the art that an improved transformer offering advantages over the prior art has been provided. Specifically, the improved transformer provides a means for heating a selected filament to a selected temperature such that the filament may then be stretched to increase the quality and tensile strength thereof. The improved transformer of the present invention offers improvements over the prior art in that the transformer temperatures attainable approach 1000° C., as opposed to 250°-300° C., which is the approximate range currently available. Further, with the method disclosed above, new materials may be developed to achieve substantially greater temperatures. The need for increasing these temperatures may be limited, however, by the physical properties of the selected filaments to be heated. The improved transformer is constructed from materials which are at least cooperatively capable of withstanding the temperatures attained thereby. Therefore, the materials serve to protect the inductor wire from contacting air, and further to prevent oxidation, and therefore breakdown, of the inductor wire.

While a preferred embodiment has been shown and described, it will be understood that it is not intended to limit the disclosure, but rather it is intended to cover all modifications and alternate methods falling within the spirit and the scope of the invention as defined in the appended claims.

Having thus described the aforementioned invention, I claim:

1. An improved induction heating transformer for producing heat to heat a selected filament having a maximum breakdown temperature, said selected filament to be stretched in order to enhance tensile strength properties thereof, said improved induction heating transformer being capable of attaining internal temperatures sufficient to heat a rotating shield to temperatures at least equal to said breakdown temperature of said selected filament, said improved induction heating transformer comprising:

a spool member including a cylindrically configured portion defining a first end and a further end;

an inductor wire wrapped around said spool member, said inductor wire including a plurality of turns in a plurality of layers, including at least a first layer and a final layer, said inductor wire being connected at one end to a power source such that heat is generated by said inductor wire as current is delivered thereto;

a base insulator for preventing direct contact between said spool member and said inductor wire, and further for insulating said spool member from said heat generated by said inductor wire;

a first insulating material for further insulating said spool member from said inductor wire;

a second insulating material encapsulating said plurality of turns of said inductor wire for preventing adjacent of said plurality of turns of said inductor wire from directly contacting one another, said second insulating material being sprayed onto said inductor wire and said first insulating material as said inductor wire is being wrapped around said spool member, said second insulating material thus filling substantially all voids formed between consecutive of said plurality of turns of said inductor wire and between said inductor wire and said first insulating material;

a third insulating material for separating each of said plurality of layers of said inductor wire;

a fourth insulating material for insulating an outer surface of said final layer of said inductor wire; and a fifth insulating material for protecting said fourth insulating material for insulating an outer surface of said final layer of said inductor wire.

2. The improved induction heating transformer of claim 1 wherein each of said plurality of turns is defined by one revolution of said inductor wire about said spool member.

3. The improved induction heating transformer of claim 1 wherein each of said plurality of layers is defined by a plurality of said turns extending from said first end of said spool member to said further end of said spool member.

4. The improved induction heating transformer of claim 1 wherein said base insulator, said second insulating material encapsulating said plurality of turns of said inductor wire, and said fifth insulating material for protecting said insulating material for insulating an outer surface of said final layer of said inductor wire are each fabricated from a selected ceramic material.

5. The improved induction heating transformer of claim 4 wherein said selected ceramic material is designed to withstand temperatures at least equal to said internal temperatures of said improved induction heating transformer.

6. The improved induction heating transformer of claim 1 wherein said inductor wire is fabricated from copper.

7. The improved induction heating transformer of claim 6 wherein said inductor wire is provided with a protective material for preventing oxidation thereof.

8. The improved induction heating transformer of claim 7 wherein said protective material is nickel plating.

9. The improved induction heating transformer of claim 1 wherein said first insulating material for further insulating said spool member from said inductor wire and said third insulating material for separating each of said plurality of layers of said inductor wire is a fabric composed of a bottom layer of woven glass fiber, an intermediate layer of mica, and a top layer of woven glass fiber.

10. The improved induction heating transformer of claim 1 wherein said fourth insulating material for insulating an outer surface of said final layer of said inductor wire is fabricated from woven glass fiber.

11. An improved induction heating transformer for producing heat to heat a selected filament having a maximum breakdown temperature, said selected filament to be stretched in order to enhance tensile strength properties thereof, said improved induction heating transformer being capable of attaining internal temperatures sufficient to heat a rotating shield to temperatures at least equal to said breakdown temperature of said selected filament, said improved induction heating transformer comprising:

a spool member including a cylindrically configured portion defining a first end and a further end;

an inductor wire wrapped around said spool member, said inductor wire including a plurality of turns in a plurality of layers, including at least a first layer and a final layer, said inductor wire being connected at one end to a power source such that heat is generated by said inductor wire as current is delivered thereto, said inductor wire being fabricated from a nickel-plated copper wire;

a base layer of a first selected insulating material for preventing direct contact between said spool member and said inductor wire, and further for insulating said spool member from said heat generated by said inductor wire, said first selected insulating material being fabricated from a selected ceramic material designed to withstand temperatures at least equal to said internal temperatures of said improved induction heating transformer;

a layer of a second selected insulating material for further insulating said spool member from said inductor wire, said second selected insulating material being a fabric composed of a bottom layer of woven glass fiber, an intermediate layer of mica, and a top layer of woven glass fiber;

an encapsulating layer of said first selected insulating material for encapsulating said plurality of turns of said inductor wire for preventing adjacent of said plurality of turns of said inductor wire from directly contacting one another, said first selected insulating material being sprayed onto said inductor wire and said second selected insulating material as said inductor wire is being wrapped around said spool member, said first insulating material thus filling substantially all voids formed between consecutive of said plurality of turns of said inductor wire and between said inductor wire and said second insulating material;

a layer of said second selected insulating material for separating each of said plurality of layers of said inductor wire;

a third insulating material for insulating an outer surface of said final layer of said inductor wire, said insulating material being fabricated from woven glass fiber; and a top layer of said first selected insulating material for protecting said insulating material for insulating an outer surface of said final layer of said inductor wire.

12. The improved induction heating transformer of claim 11 wherein each of said plurality of turns is defined by one revolution of said inductor wire about said spool member.

13. The improved induction heating transformer of claim 11 wherein each of said plurality of layers is defined by a plurality of said turns extending from said first end of said spool member to said further end of said spool member.

14. A method of winding an improved induction heating transformer for producing heat to heat a selected filament having a maximum breakdown temperature, said improved induction heating transformer being capable of attaining internal temperatures sufficient to heat a rotating shield to temperatures at least equal to said breakdown temperature of said selected filament, said improved induction heating transformer including at least a spool body, said method of winding said improved induction heating transformer comprising the steps of:

(a) applying a base coat of a first selected insulating material to an exterior surface defined by said spool body, said first selected insulating material being in a liquid state;

(b) applying a layer of a second selected insulating material to said first selected insulating material;

(c) attaching an inductor wire at one end to said spool body;

(d) winding said inductor wire around said spool body a plurality of turns from a first end of said spool body to a further end of said spool body, said plurality of turns forming a layer;

(e) applying said first selected insulating material to said inductor wire and said second selected insulating material simultaneously with said step of winding said inductor wire around said spool body, said first selected insulating material being applied proximate said inductor wire to prevent the formation of voids between consecutive pairs of said plurality of turns of said inductor wire, and between said inductor wire and said layer of said second selected insulating material, said first selected insulating material being applied by spraying;

(f) repeating said steps of applying a layer of said second selected insulating material to said first selected insulating material, attaching an inductor wire at one end to said spool body, winding said inductor wire around said spool body a plurality of turns from said first end of said spool body to said further end of said spool body, and applying said first selected insulating material to said inductor wire and said second selected insulating material simultaneously with said step of winding said inductor wire around said spoof body a plurality of times;

(g) applying a layer of a third selected insulating material to an exposed layer of said first insulating material;

(h) applying a layer of said first selected insulating material to said layer of said third selected insulating material; and (i) drying said first selected insulating material.

15. The method of claim 14 wherein said first selected insulating material is a selected ceramic material defining physical properties capable of withstanding said internal temperatures of said improved induction heating transformer.

16. The method of claim 14 wherein said second selected insulating material is a fabric composed of a bottom layer of woven glass fiber, an intermediate layer of mica, and a top layer of woven glass fiber.

17. The method of claim 14 wherein said third selected insulating material is fabricated from woven glass fiber.

18. The method of claim 14 wherein said inductor wire is fabricated from a nickel-plated copper wire.

19. The method of claim 15 wherein said step of drying said first selected insulating material includes the steps of air-drying said selected ceramic material for a selected period of time, and kiln-drying said selected ceramic material for selected periods of time at respective selected temperatures.

* * * * *